US005381854A

United States Patent [19]

Thomson et al.

[11] Patent Number: 5,381,854

[45] Date of Patent: Jan. 17, 1995

[54] PNEUMATIC FLOW CONTROL OF LIQUID METALS

[75] Inventors: Robert Thomson, Ontario; Flhachmi Essadiqi, Aylmer; James Barry, Nepean, all of Canada

[73] Assignee: Her Majesty in right of Canada as represented by the Minister of Energy, Mines and Resoruces, Canada

[21] Appl. No.: 36,283

[22] Filed: Mar. 24, 1993

[30] Foreign Application Priority Data

Jan. 29, 1993 [CA] Canada ..... 2088401

[51] Int. Cl.[6] ..... B22D 11/06; B22D 11/18

[52] U.S. Cl. ..... 164/453; 164/155.3; 164/450.1; 164/449.1; 164/479; 164/429

[58] Field of Search ..... 164/452, 453, 454, 479, 164/155, 449, 427, 488, 437, 429, 155.3, 449.1, 450.1

[56] References Cited

U.S. PATENT DOCUMENTS

| | | | |
|---|---|---|---|
| 3,384,150 | 5/1968 | Newsome | 164/155 |
| 4,339,508 | 7/1982 | Tsuya | 164/437 |
| 4,392,523 | 7/1983 | Beller et al. | 164/453 |
| 4,441,541 | 4/1984 | Block | 164/453 |
| 4,449,568 | 5/1984 | Narasimham | 164/453 |
| 4,471,831 | 9/1984 | Ray | 164/437 |
| 4,592,411 | 6/1986 | Bedell | 164/479 |
| 4,600,047 | 7/1986 | Matoba et al. | 164/453 |
| 4,625,787 | 12/1986 | Haveman et al. | 164/453 |
| 4,774,997 | 10/1988 | Eibe | 164/449 |

FOREIGN PATENT DOCUMENTS

| | | | |
|---|---|---|---|
| 810587 | 4/1969 | Canada . | |
| 814336 | 6/1969 | Canada . | |
| 906182 | 8/1972 | Canada . | |
| 914879 | 11/1972 | Canada . | |
| 915382 | 11/1972 | Canada . | |
| 1040832 | 10/1978 | Canada . | |
| 1178019 | 11/1984 | Canada . | |
| 4258365 | 9/1992 | Japan | 164/479 |
| 9013377 | 11/1990 | WIPO | 164/479 |

*Primary Examiner*—P. Austin Bradley
*Assistant Examiner*—Erik R. Puknys
*Attorney, Agent, or Firm*—Jacobson, Price, Holman & Stern

[57] ABSTRACT

A method and apparatus are disclosed for pneumatically controlling the velocity of flow of liquid metal from a tundish into a continuous casting machine through a nozzle. A chamber encloses the nozzle outlet, and at least a portion of the continuous casting machine, and a pressurized gas is supplied to the chamber. The flow velocity of the liquid metal at the nozzle outlet is controlled by controlling the gas pressure in the chamber in response to the level of the liquid metal in the tundish, and the measured atmospheric pressure acting on the liquid metal in the tundish.

14 Claims, 4 Drawing Sheets

| Liquid Metal | Circular Outlet Maximum Diameter (mm) | Rectangular Outlet Maximum Height (mm) |
|---|---|---|
| Hg | 5.4 | 3.8 |
| Pb | 5.8 | 4.0 |
| Sn | 8.0 | 5.6 |
| Zn | 10.0 | 7.0 |
| Cu | 11.4 | 8.0 |
| Ni | 13.6 | 9.6 |
| Fe | 14.8 | 10.5 |
| Mg | 16.9 | 12.0 |
| Al | 17.6 | 12.5 |
| Ti | 18.0 | 12.8 |

FIGURE 5

PNEUMATIC FLOW CONTROL OF LIQUID METALS

FIELD OF THE INVENTION

The present invention relates in general to a method and apparatus for controlling the flow of liquid metal, and in particular to a method and apparatus for pneumatically controlling the flow of liquid metal from a tundish of a continuous casting machine.

BACKGROUND TO THE PRESENT INVENTION

Continuous casting systems are well known in the prior art. In general, liquid metal flows from a reservoir or tundish, through a nozzle and into a continuous casting machine. Various casting machines are known, including twin roller, twin belt, and one belt systems, in which the liquid metal is delivered between the rollers (or belts) and cools and solidifies therein. There is also known single roller strip-casting systems, in which the liquid metal is supplied to the surface of the roller, and cools and solidifies thereon.

In all of the known continuous casting machines, variations in the flow rate of the liquid metal can have a large (and usually detrimental) effect on the quality of the cast metal. It is therefore important that the rate at which liquid metal is delivered through the nozzle to the casting machine is carefully controlled to be as constant as possible.

Various means have been proposed for ensuring that liquid metal can be delivered to the casting machine at a highly controlled, and substantially constant rate.

For example, U.S. Pat. No. 3,384,150 (Ewsome) discloses a system in which a reservoir of molten metal is located within a pressure vessel. The reservoir is connected to a tundish so that molten metal can be forced, by means of gas pressure within the pressure vessel, from the reservoir to the tundish. In addition, the tundish is enclosed so that gas pressure can be applied to the liquid metal within the tundish. In operation, a quantity of molten metal is supplied to the reservoir, and the pressure vessel is then sealed. At this point, pressurised gas is supplied to the pressure vessel to force the molten metal into the tundish. A further supply of pressurised gas is provided to the tundish, to force the molten metal from the tundish and into a mold or casting machine. The gas pressure in the tundish is controlled to maintain a constant flow rate into the mold, while the pressure in the pressure vessel is varied to maintain a constant level of molten metal in the tundish.

U.S. Pat. No. 4,449,568 (Narasimham) discloses another system in which an inverted pressure bell is partially immersed in liquid metal in a tundish. By varying the gas pressure in the pressure bell, the level of liquid metal outside the pressure bell (and thus the hydrostatic pressure at the tundish outlet) can be maintained substantially constant.

Both of these known systems teach the use of a pressurised gas acting directly on the molten metal as a means for controlling the flow of molten metal from the tundish. However, the system taught by U.S. Pat. No. 3,384,150 relies upon a combination of pressure applied within the tundish, and maintenance of a substantially constant metal level within the tundish, to ensure constant metal flow rate to the mold. The system disclosed in U.S. Pat. No. 4,449,568 relies exclusively on maintenance of a constant level of molten metal in the tundish to ensure a constant rate of flow therefrom.

In either of the above-mentioned prior art systems, if the level of metal in the tundish is allowed to drop, due, for example, to an interruption of the flow of metal into the tundish, maintenance of a constant flow rate of metal into the casting machine would become difficult or impossible. A further disadvantage of the prior art systems is that operating by means of gas pressure acting directly on the liquid metal necessarily complicates the liquid metal handling system, thereby increasing its cost and the risk of failure. Furthermore (particularly in the case of U.S. Pat. No. 3,384,150), true continuous casting is impossible, because a reservoir of molten metal must be placed in a sealed chamber prior to beginning the casting operation. When the liquid metal in the reservoir is consumed, the casting operation must be interrupted to permit the supply of liquid metal in the reservoir to be replenished.

SUMMARY OF THE INVENTION

An object of the present invention is the provision of an improved method and apparatus for controlling the flow of liquid metals, whereby flow rate can be maintained substantially constant independent of the level of liquid metal in the tundish.

According to an aspect of the present invention, there is provided an apparatus for controlling the velocity of flow of liquid metal from a tundish into a continuous casting machine through a nozzle, said apparatus comprising chamber means enclosing an outlet of the nozzle and at least a portion of the casting machine; pressure supply means, for supplying pressurised gas to said chamber means so as to maintain a gas pressure within said chamber means at a level at least equal to ambient atmospheric pressure; first pressure sensing means for sensing a gas pressure within the tundish; second pressure sensing means for sensing the gas pressure within said chamber means; level sensing means for sensing the level of liquid metal in the tundish; and control means responsive to said first and second pressure sensing means, and said level sensing means, for controlling the gas pressure in said chamber means, whereby the velocity of flow of liquid metal from the tundish into the continuous casting machine through the nozzle is controlled by varying the gas pressure in said chamber means.

According to another aspect of the present invention, there is provided a method of controlling the velocity of flow of liquid metal from a tundish into a continuous casting machine through a nozzle, said method comprising the steps of: sensing a gas pressure acting on liquid metal in the tundish; sensing the level of liquid metal in the tundish; sensing a gas pressure acting on the liquid metal at an outlet of the nozzle; and controlling the gas pressure acting on the liquid metal at the outlet of the nozzle in response to the measured height of liquid metal in the tundish with respect to the outlet of the nozzle, and the gas pressure acting on the metal in the tundish, whereby the velocity of flow of liquid metal from said tundish into said continuous casting machine through said nozzle is controlled by varying the gas pressure acting on the liquid metal at the outlet of the nozzle.

Preferably, the tundish is open to the atmosphere, thereby permitting ready access for addition of liquid metal during a casting operation.

Preferably, the control means includes a pneumatic control unit driven by a control computer. The pneumatic control unit preferably includes pressure sensor ports to which respective pneumatic tubes can be attached, the open end of each tube being located in the region in which the gas pressure is to be detected. The pneumatic control unit then converts the detected gas pressure into an electronic signal which is supplied, as a feedback signal, to a computer. Such an arrangement ensures accurate pressure readings, without exposing sensitive electronic circuits to the extreme conditions present, for example, in the tundish.

The level of liquid metal in the tundish can be measured by any known means appropriate to the temperature regime of the liquid metal (such as, for example, a float connected to a Linear Voltage Differential Transducer (LVDT), or a laser or other optical device, or other known liquid level detection devices employing ultra-sound or electromagnetic or radiation absorption techniques), connected to the control computer, so that the level of liquid metal in the tundish can be detected to a high degree of accuracy.

In a preferred embodiment, the control computer also receives a signal from the speed control of the casting machine, so that the flow rate of liquid metal can be continuously controlled and the flow rate optimized for the casting speed of the machine.

In a further preferable embodiment, gas pressure within the chamber is controlled by means of a valve controlled by the pneumatic controller, whereby opening of the valve releases gas from the chamber, thereby causing a reduction in the gas pressure.

In an alternative embodiment, gas pressure in the chamber is controlled by means of a valve located in the supply line between a source of pressurised gas, and the chamber, whereby opening of the valve increases the flow of pressurised gas to the chamber, thereby causing an increase in gas pressure.

BRIEF DESCRIPTION OF THE DRAWINGS

Embodiments of the invention will now be described in detail by way of example, with reference to the appended drawings, in which:

FIG. 5 shows a table of maximum allowable diameters and heights of circular and rectangular nozzle outlets, respectively, for a variety of liquid metals.

DETAILED DESCRIPTION OF A PREFERRED EMBODIMENT

Figure 1:
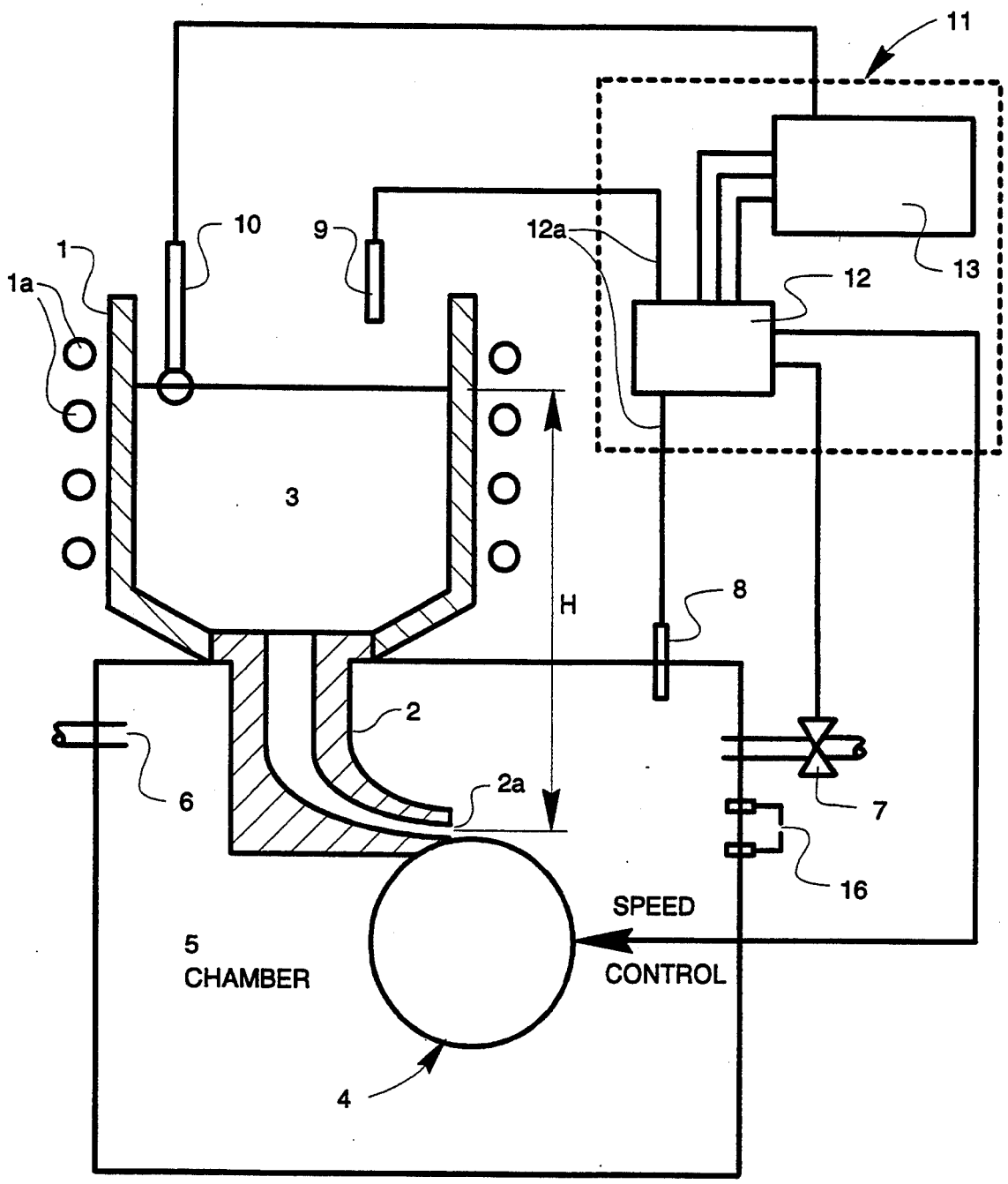
FIG. 1 is a schematic illustration of a continuous casting system according to an embodiment of the present invention

Referring now to FIG. 1, which schematically illustrates a tundish 1 and nozzle 2 containing liquid metal 3, which flows through the nozzle 2 and into a continuous casting machine 4. In the illustrated embodiment, the continuous casting machine 4 is shown as a single-roller strip casting machine, although it will be understood that the present invention can equally be used with other types of continuous casting machines. Surrounding the continuous casting machine 4 is a chamber 5 having a pressure gas inlet 6 and relief valve 7.

As illustrated in FIG. 1, an induction coil 1*a* may be provided around the tundish 1 to ensure that the liquid metal 3 in the tundish 1 and nozzle 2 does not cool and solidify. A second induction coil (not shown) can be placed around the nozzle 2 to further control heating or superheating of the liquid metal therein.

The chamber 5 is supplied with pressurised gas from a suitable source (not shown) through the pressure gas inlet line 6. In one embodiment of the present invention, the supply of pressure gas is continuous, and the gas pressure in the chamber controlled by means of the relief valve 7. In an alternate embodiment, the supply of pressure gas can be controlled, for example by means of a valve (not shown) in the pressure gas supply line 6. The gas can suitably be selected according to the type of metal in question. For example, for iron and steel, air or nitrogen can advantageously be employed, For highly reactive metals (such as, for example, Ti, Zr and Mg) the gas can be selected to minimize reoxidation of the liquid metal in the vicinity of the nozzle outlet 2*a*.

The chamber 5 further includes one or more pressure seals 16, which facilitates continuous removal of solidified metal from the chamber 5, while minimizing leakage of pressure gas. By this means, solidified metal can be continuously removed from the chamber 5 without disturbing control of the gas pressure $P_1$ within the chamber 5, and therefore the liquid metal flow control characteristics out of the nozzle 2.

A chamber pressure sensor 8 measures the gas pressure $P_1$ within the chamber 5, and thus the gas pressure acting at the outlet 2*a* of the nozzle 2. A tundish pressure sensor 9 measures the gas pressure within (or near) the tundish 1, and thus the gas pressure $P_0$ acting on the liquid metal 3 in the tundish 1. A Linear Voltage Differential Transducer (LVDT) 10, or other suitable level measuring device (not shown), measures the level of liquid metal 3 in the tundish 1, which, in combination with the known geometry of the tundish 1 and nozzle 2, permits determination of the height H of the liquid metal 3 above the outlet 2*a* of the nozzle 2.

Various means may be utilised to implement the chamber and tundish pressure sensors, 8 and 9 respectively. For example, the sensors can comprise conventional pressure-sensitive transducers, which detect the gas pressure directly, and generate corresponding electrical signals. Alternatively, the sensors can include pneumatic tubes which are connected at one end to remote pressure transducers. The open end of the pneumatic tubes are then situated at or near the location at which the gas pressure is to be detected. This alternative arrangement has the advantage that the pressure transducers can be placed at a location remote from the high temperature environment existing near the tundish 1 and the casting machine 4.

Overall control of the system can be provided by means of a process control system 11 generally comprising a controller unit 12 and a computer 13. The controller unit 12, which can be a pneumatic controller, can include pressure reading input ports 12*a* for connection to the chamber and tundish pressure sensors, 8 and 9, as well as control signal output ports 12*b* for controlling the relief valve 7. The pressure reading input ports 12*a* can comprise electronic connections for receiving electrical signals from pressure transducers. Alternatively, the input ports 12*a* can comprise pneumatic inlets connected to pressure transducers within the controller unit. In addition, the controller unit 12 can include data output ports, which facilitate connection to a computer 13, or a recording device (not shown) for data acquisition, thereby facilitating analysis of the operational parameters of the system.

The computer 13 controls the controller unit 12 (according suitable programming) in response to the measured chamber and tundish pressures $P_1$ and $P_0$ respectively, and the level of the liquid metal 3 in the tundish 1 in order to provide the desired velocity of flow at the outlet 2a of the nozzle 2. The principle of operation of the system is described in detail in the following paragraphs.

The key element is to control the velocity V of the liquid metal 3 at the outlet 2a of the nozzle 2, which is given by:

$$V = C_d\sqrt{\frac{2\Delta P}{\rho}} \quad \text{[eqn. 1]}$$

where $C_d$ is a discharge coefficient that depends on Reynolds number, nozzle configuration and liquid velocity V. ΔP, which is the pressure of the liquid metal 3 at the outlet 2a, is given by:

$$\Delta P = \rho gH + P_0 - p_1 \quad \text{[eqn. 2]}$$

or (from [eqn. 1]):

$$\Delta P = \frac{\rho}{2}\left(\frac{V}{C_d}\right)^2 \quad \text{[eqn. 3]}$$

where $P_0$ is the (nominally ambient atmospheric) pressure in the tundish 1, and $P_1$ is the pressure inside the chamber 5. H is the height of the liquid metal 3 in the tundish 1, with respect to the outlet 2a of the nozzle 2. ρ and g, of course, represent the density of the liquid metal, and gravitational acceleration, respectively. $P_1$ can be determined from equations [2] and [3] as follows:

$$P_1 = \rho gH + P_o - \frac{\rho}{2}\left(\frac{V}{C_d}\right)^2 \quad \text{[eqn. 4]}$$

For a constant Liquid velocity V and thus a constant ΔP, the pressure P1 is related in a linear manner to the liquid height H. So that:

$$P_1 = \rho gH + C_1 \quad \text{[eqn. 5]}$$

where $$C_1 = P_o - \frac{\rho}{2}\left(\frac{V}{C_d}\right)^2$$

is a constant.

For a constant liquid level, H, the pressure P1 can be related to the liquid velocity V as follows:

$$P_1 = -\frac{\rho}{2}\left(\frac{V}{C_d}\right)^2 + C_2 \quad \text{[eqn. 6]}$$

where $C_2 = \rho gH + P_0$ is a constant.

The parameter that controls the flow velocity at the nozzle outlet 2a is the pressure $P_1$ in the chamber 5 through equation [5] in the case of a variable liquid level, H, and through equation [6] in the case of a constant liquid level.

In order to provide a better understanding of the operation of the present invention, the following two examples are provided.

EXAMPLE 1

Constant Liquid Level in the Tundish

During casting, the liquid level, H, in the tundish is maintained constant by continuously adding additional liquid metal. This operation, of course, can be controlled by the computer 13 on the basis of the liquid metal level indicated by the LVDT 10 (or other suitable liquid level measuring means). Given a constant liquid level in the tundish 1, the velocity V of the liquid metal at the outlet 2a of the nozzle 2 is controlled only by the pressure $P_1$ in the chamber, according to equation [6]. For example, the velocity V of liquid steel (density: $\rho = 7200\ kg/m^3 \approx 450\ lb/ft^3$) if; and amend "H=1 m" to read H=1 m (≈39.4 inches) may be varied in a controlled manner, from 0 m/s (=0 ft/s) to a maximum of 4 m/s (≈13.12 ft/s) by controlling $P_0$=atmospheric pressure and computer controlling $P_1$ in the range 0.17 MPa (≈24.5 psi) to 0.1 MPa (≈14.5 psi).

The pressure $P_1$ inside the chamber is controlled by the valve 7 opening through the controller unit 12 and using the sensors 8 and 9, and the value of $P_1$ in turn controls the velocity V.

While the liquid level in the tundish can be maintained substantially constant, small fluctuations in the liquid level are virtually inevitable. These fluctuations in H can be compensated for by varying $P_1$, using equation [5], to keep the velocity V constant.

EXAMPLE 2

Varying Liquid Level in the Tundish

In a batch process the liquid metal level H decreases during the casting operation. To keep the velocity V of the liquid metal 3 at the outlet 2a constant, the pressure ΔP at the outlet 2a must also be kept constant. In this case, the chamber pressure $P_1$ is caused to decrease according to equation 5.

The process control system is used to control the pressure $P_1$ as follows: The LVDT 10 (or other suitable liquid level measuring means) monitors the liquid level in the tundish 1, and the chamber pressure sensor 8 measures the pressure $P_1$ inside the chamber. The liquid level measured by the LVDT 10 (or other suitable liquid level measuring means) is used to calculate (using equation [5]), the required pressure value $P_1$ needed to keep ΔP constant. The controller unit 12 is then caused to control the valve 7 so that the pressure inside the chamber 5 matches the required value.

Thus, as H decreases during casting, the servo-system progressively reduces $P_1$ to keep V at the required level.

One important feature of the method of the invention is that the flow velocity of liquid metal does not depend on the shape of the nozzle outlet 2a. In the case of a circular outlet, there is a maximum diameter below which the fluid flow can be controlled pneumatically by the method according to the invention. In the case of a nozzle with a rectangular section, the condition of maximum outlet dimension applies only to the height with no limit to the nozzle width. This maximum dimension depends on the surface tension and the density of liquid metal.

Figure 2:
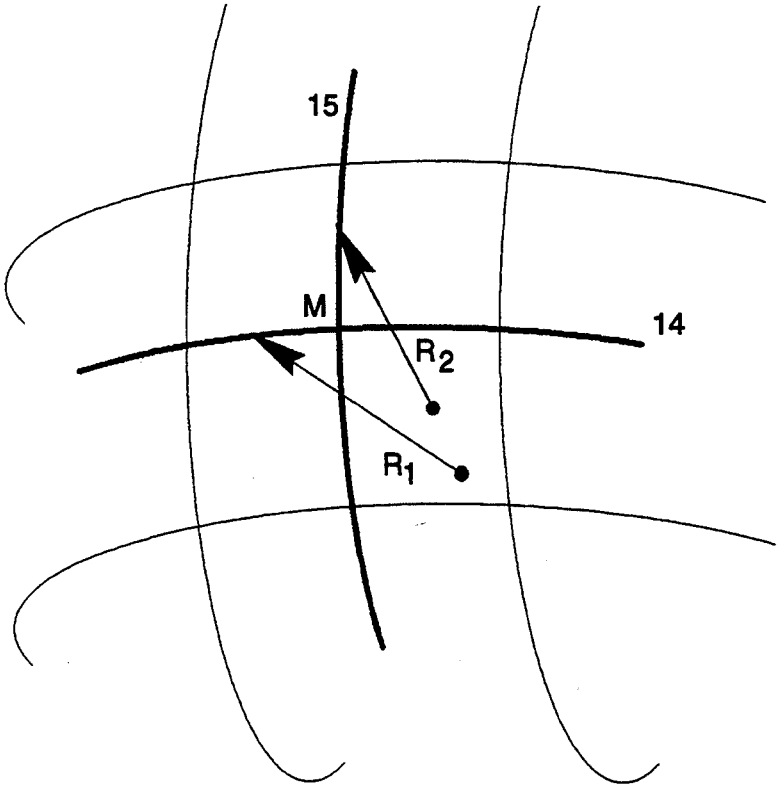
FIG. 2 is a schematic representation showing the notation used to analyze the curvature of a general surface of separation between two fluid media.

In general, if two media, here liquid metal and gas, are separated by curved surface, as shown schematically in FIG. 2, the pressures near it in the two media are different. If the two media are in thermodynamic equilibrium together, the pressure difference (called surface pressure) is given by the following relation:

$$P_1 - P_2 = \sigma\left(\frac{1}{R_1} + \frac{1}{R_2}\right) \quad \text{[eqn. 7]}$$

where $\sigma$ is the surface tension of liquid metal, $R_1$ and $R_2$ are the principal radii of curvature at a given point of the surface of the liquid metal and $P_1$ and $P_2$ are the pressures in the two media.

Special Case 1: Nozzle having a circular outlet

When the outlet of the nozzle is circular, the shape of the surface of separation of liquid metal and the gas is (ideally) spherical with a radius $R=R_1=R_2$. R is also the radius of the circular section of the nozzle.

Figure 3:
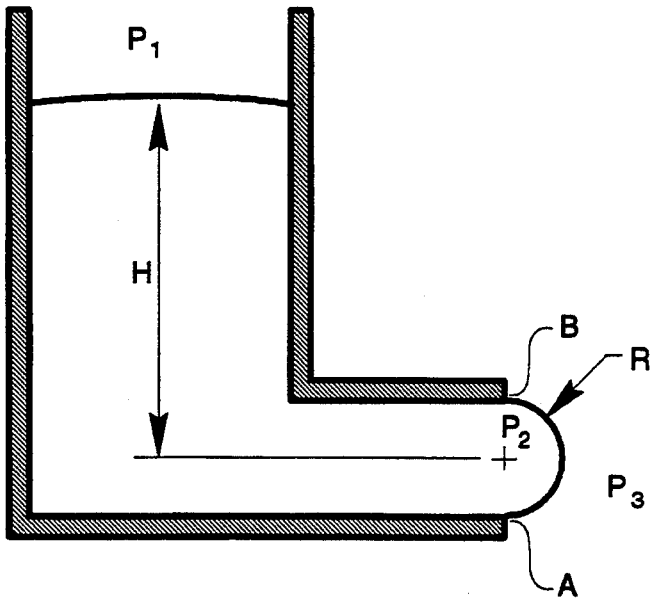
FIG. 3 is a schematic illustration showing the notation used to analyze a surface of separation in the case of a nozzle having a circular outlet.

Referring to FIG. 3, H is the height of the liquid metal under pressure $P_1$. $P_2$ is the hydrostatic pressure inside the metal at the nozzle. $P_3$ is the pressure at the metal/gas interface at the nozzle exit. Thus:

$$P_2 = P_1 + H \quad \text{[eqn. 8]}$$

$$P_2 - P_3 = \sigma\left(\frac{1}{R_1} + \frac{1}{R_2}\right) \quad \text{[eqn. 9]}$$

$$P_1 - P_2 = 2\frac{\sigma}{R} \quad \text{[eqn. 10]}$$

where:

$\sigma$ is the surface tension of liquid metal;

$R_1$ and $R_2$ are the principal radii of curvature at a given point of the surface of the liquid at the exit of the nozzle, which in the present case is spherical in shape with $R_1=R_2=R$.

The presence of the pressure gradient from B to A, if it is small, can be equilibrated by the liquid surface tension and a small adjustment in the shape of the liquid surface at the nozzle exit. The shape of the free surface of the liquid at the nozzle exit is assumed (for the purposes of analysis) to be a perfect half sphere. Under equilibrium conditions at points A and B the absolute value of the variation of the pressure is equal to:

$$|P_2-P_3| = \sigma g R \quad \text{[eqn.11]}$$

Combining equations [10] and [11], R can be subtracted as follows:

$$R_{max} = \sqrt{\frac{2\sigma}{\rho g}} \quad \text{[eqn. 12]}$$

where $R_{max}$ represents the maximum radius of a circular section of cylindrical nozzle that can allow the flow to be controlled pneumatically by the method of the present invention. If R is higher than $R_{max}$, the hydrostatic pressure gradient from B to A will be too high to equilibrate.

Special case 2: Nozzle having a rectangular outlet

Figure 4A:
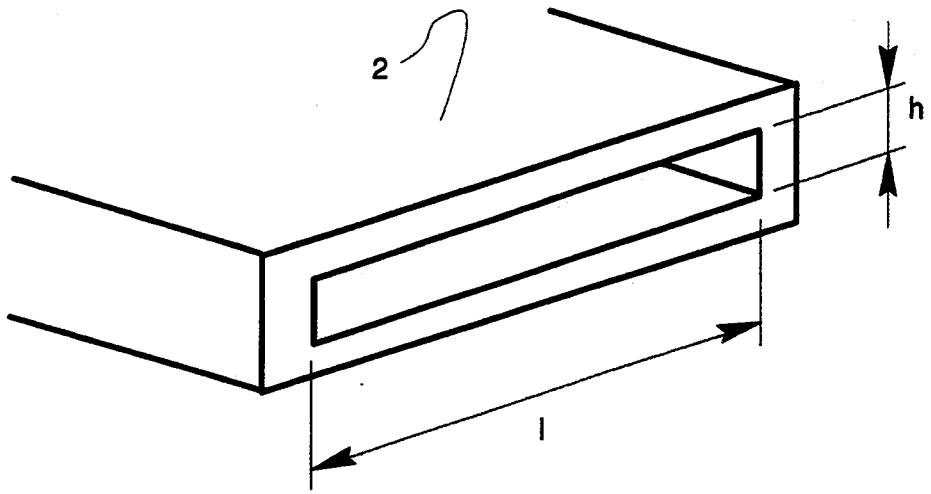
FIGS. 4*a* and 4*b* are schematic representations showing the notation used to analyze a surface of separation in the case of a nozzle having a rectangular outlet.
Figure 4B:
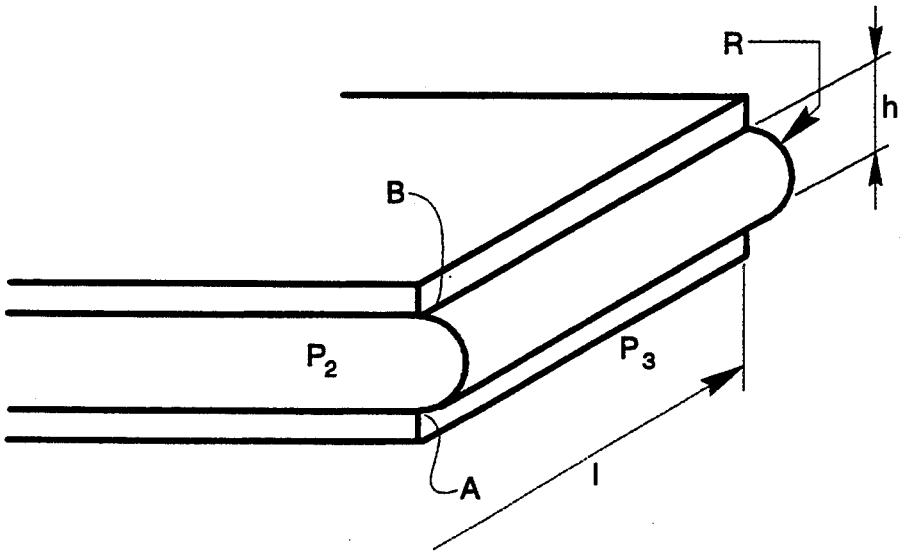

When the outlet of the nozzle is rectangular, the shape of the surface of separation of the liquid metal and the gas is cylindrical with radius $R_1=h/2$, and $R_2=\infty$ Referring to FIGS. 4*a* and 4*b*, h is the height of the nozzle outlet and 1 is its width. In this case:

$$P_2 - P_3 = 2\frac{\sigma}{h} \quad \text{[eqn. 13]}$$

As in the previous case, under equilibrium conditions, the value of $|P_2-P_3|$ is equal to:

$$|P_2-P_3| = \rho g h \quad \text{[eqn. 14]}$$

From equations [13] and [14] the maximum height of the nozzle that can permit the flow to be pneumatically controlled is:

$$h_{max} = 2\sqrt{\frac{\sigma}{\rho g}} \quad \text{[eqn. 15]}$$

There is no limit on the width, the nozzle can be as wide as required for production, except for mechanical limitations, particularly with respect to rectilinarity of the nozzle opening at higher values of 1. If h exceeds $h_{max}$, the hydrostatic pressure gradient through the nozzle opening thickness will be too high to equilibrate.

The maximum radius, and thus diameter, of the circular nozzle outlet section and the maximum height of the rectangular nozzle outlet section depend only on the surface tension and the density of the liquid metal.

The table in FIG. 5 illustrates values of the maximum diameters and heights of nozzles with circular and rectangular outlets, respectively, for some liquid metals. In an industrial application, the presence of an adhering oxide film on the liquid metal surface at nozzle exit may effectively increase the maxima shown in FIG. 5.

It will be apparent to those skilled in the art that there are a variety of ways in which the features of the invention can be implemented without departing from the scope of the invention.

For example, the chamber 5 has been described a surrounding the continuous casting machine 4. However, it will be apparent that the chamber 5 could equally be constructed so as to enclose a comparatively small volume surrounding the outlet 2*a* of the nozzle 2. In this case suitable sealing means could be provided to minimize leakage of pressure gas from the chamber 5, between the walls of the chamber 5 and the casting machine 4 and solidified metal downstream of the outlet 2*a*. The advantage, in this case, is that by minimizing the volume of the chamber 5, the volume of pressure gas required by the system is reduced. Additionally, because a lower volume of gas is involved, pressure changes in the chamber 5 can be effected more rapidly, and thus the responsiveness of the control system is increased.

Furthermore, a filter can be installed inside the nozzle to eliminate turbulence and induce laminar fluid flow. Installation of a filter also allows the cleanliness of liquid metal to be improved by retaining oxide inclusions.

We claim:

1. An apparatus for controlling the velocity of flow of liquid metal from a tundish into a continuous casting machine through a nozzle, said apparatus comprising:
   chamber means enclosing an outlet of the nozzle and at least a portion of the casting machine;
   pressure supply means, for supplying pressurised gas to said chamber means so as to maintain a gas pressure within said chamber means at a level at least equal to ambient atmospheric pressure;
   first pressure sensing means for sensing a gas pressure within the tundish;
   second pressure sensing means for sensing the gas pressure within said chamber means;
   level sensing means for sensing the level of liquid metal in the tundish; and
   control means responsive to said first and second pressure sensing means, and said level sensing means, for controlling the gas pressure in said chamber means, whereby the velocity of flow of liquid metal from the tundish into the continuous casting machine through the nozzle is controlled by varying the gas pressure in said chamber means.

2. An apparatus as claimed in claim 1, wherein said chamber means substantially surrounds the casting machine.

3. An apparatus as claimed in claim 1, wherein said first pressure sensing means comprises a pressure sensitive transducer for producing an electrical signal indicative of a detected gas pressure.

4. An apparatus as claimed in claim 1, wherein said second pressure sensing means comprises a pressure sensitive transducer for producing an electrical signal indicative of a detected gas pressure.

5. An apparatus as claimed in claim 1, wherein said level sensing means generates an electrical signal indicative of a measured height of liquid metal in the tundish.

6. An apparatus as claimed in claim 1, wherein an outlet of said nozzle is circular in section, and has a maximum radius given by the equation:

$$R_{max} = \sqrt{\frac{2\sigma}{\rho g}}$$

where $\sigma$ is the surface tension of the liquid metal, and $\rho$ is the density of the liquid metal.

7. An apparatus as claimed in claim 1, wherein an outlet of said nozzle is rectangular in section, and has a maximum height given by the equation:

$$h_{max} = 2\sqrt{\frac{\sigma}{\rho g}}$$

where $\sigma$ is the surface tension of the liquid metal, and $\rho$ is the density of the liquid metal.

8. An apparatus as claimed in claim 1, wherein said control means includes valve means for controllably releasing gas from said chamber means.

9. An apparatus as claimed in claim 8, wherein said control means further includes a controller unit for automatically controlling said valve means, whereby the gas pressure in said chamber means is continuously controlled to ensure a predetermined flow velocity of liquid metal from the tundish.

10. An apparatus as claimed in claim 1, wherein said control means includes valve means for controlling a flow of gas from said pressure supply means to said chamber means.

11. An apparatus as claimed in claim 10, wherein said control means further includes a controller unit for automatically controlling said valve means, whereby the gas pressure in said chamber means is continuously controlled to ensure a predetermined flow velocity of liquid metal from the tundish.

12. A method of controlling the velocity of flow of liquid metal from a tundish into a continuous casting machine through a nozzle, said method comprising the steps of:
   sensing a gas pressure acting on liquid metal in the tundish;
   sensing the level of liquid metal in the tundish;
   sensing a gas pressure acting on the liquid metal at an outlet of the nozzle; and
   controlling the gas pressure acting on the liquid metal at the outlet of the nozzle in response to the measured height of liquid metal in the tundish with respect to the outlet of the nozzle, and the gas pressure acting on the metal in the tundish, whereby the velocity of flow of liquid metal from said tundish into said continuous casting machine through said nozzle is controlled by varying the gas pressure acting on the liquid metal at the outlet of the nozzle.

13. A method as claimed in claim 12, wherein, for a constant velocity of flow of liquid metal from the outlet of the nozzle, the gas pressure acting on the liquid metal at the outlet of the nozzle is controlled according to the equation:

$$P_1 = \rho g H + C_1$$

wherein:

$P_1$ is the gas pressure acting on the liquid metal at the outlet of the nozzle;

H is the measured height of liquid metal in the tundish with respect to the outlet of the nozzle; and $C_1$ is a constant.

14. A method as claimed in claim 12, wherein, for a constant height of liquid metal in the tundish, the gas pressure acting on the liquid metal at the outlet of the nozzle is controlled according to the equation:

$$P_1 = \frac{\rho}{2}\left(\frac{V}{C_d}\right)^2 + C_2$$

wherein:

V is a desired flow velocity of liquid metal at the outlet of the nozzle;

$P_1$ is the gas pressure acting on the liquid metal at the outlet of the nozzle;

$C_d$ is a discharge coefficient that depends on Reynolds number, nozzle configuration and liquid velocity; and $C_2$ is a constant.

* * * * *

UNITED STATES PATENT AND TRADEMARK OFFICE

CERTIFICATE OF CORRECTION

PATENT NO. : 5,381,854

DATED : January 17, 1995

INVENTOR(S) : Robert THOMSON et al

It is certified that error appears in the above-identified patent and that said Letters Patent is hereby corrected as shown below:

On title page, item

[75] Inventors: Robert Thomson, Ottawa; Elhachmi Essadiqi, Aylmer; James Barry, Nepean, all of Canada

[73] Assignee: Her Majesty in right of Canada as represented by the Minister of Energy, Mines and Resources, Canada Col. 6, lines 29-30:

$p=7200\ Kg/m^3 \approx 450\ lb/ft^3)$, if H=1m ($\approx$ 39.4 inches) may be varied in a con- Signed and Sealed this Twenty-seventh Day of June, 1995

*Attest:*

Bruce Lehman

BRUCE LEHMAN

*Attesting Officer*

*Commissioner of Patents and Trademarks*